US011624184B1

(12) United States Patent
Wigboldy et al.

(10) Patent No.: US 11,624,184 B1
(45) **Date of Patent: *Apr. 11, 2023**

(54) WALL SYSTEM FASTENER ASSEMBLY FOR BUILDING VENEERS AND CLADDINGS

(71) Applicant: Altenloh, Brinck & Co. US, Inc., Bryan, OH (US)

(72) Inventors: Jason R. Wigboldy, Grand Rapids, MI (US); Mitchell B. Mahler, Grand Rapids, MI (US); David Boyd, Grand Rapids, MI (US)

(73) Assignee: Altenloh, Brinck & Co. US, Inc., Bryan, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/388,720

(22) Filed: Jul. 29, 2021

Related U.S. Application Data

(63) Continuation of application No. 16/661,438, filed on Oct. 23, 2019, now Pat. No. 11,078,663.

(Continued)

(51) Int. Cl.

| | |
|---|---|
| ***E04B 1/41*** | (2006.01) |
| ***E04F 13/08*** | (2006.01) |
| ***E04B 1/76*** | (2006.01) |

(52) U.S. Cl.

CPC ..... *E04B 1/4178* (2013.01); *E04B 1/7616* (2013.01); *E04B 1/7633* (2013.01); *E04B 1/7637* (2013.01); *E04F 13/0833* (2013.01)

(58) Field of Classification Search

CPC .... E04B 1/7616; E04B 1/7633; E04B 1/7637; E04B 1/4178

See application file for complete search history.

(56) References Cited

U.S. PATENT DOCUMENTS

| | | | |
|---|---|---|---|
| D32,793 | S | 6/1900 | Fauber |
| 2,304,333 | A | 5/1940 | Bossi |

(Continued)

FOREIGN PATENT DOCUMENTS

| | | | |
|---|---|---|---|
| CA | 2234485 | A1 | 10/1999 |
| CA | 2690819 | C | 8/2012 |

(Continued)

OTHER PUBLICATIONS

Brochure disclosing 2" diameter Plasti-Grip® PBLP2 washer distributed by Rodenhouse Inc. more than one year prior to Sep. 6, 2012.

(Continued)

*Primary Examiner* — Adriana Figueroa

(74) *Attorney, Agent, or Firm* — Gardner, Linn, Burkhart & Ondersma LLP

(57) ABSTRACT

A wall fastener assembly for retaining an exterior wall covering alongside a wall includes a screw, an elongated shank and a washer. The shank is configured to provide a space for a layer of insulation between the exterior wall covering and the wall. The shank comprises a center bore extending along the length of the shank for receiving the screw configured to secure the wall fastener assembly to the wall. The shank also includes a pair of flanges positioned opposite the wall. The pair of flanges form a groove between them. The groove configured to receive a masonry tie, wire tie or a girt track. The washer includes a central portion comprising a center hole for receiving the shank. The wire tie includes a narrow portion configured to be retained by the groove. A seal may be provided on the shank to seal the wall fastener assembly with the insulation.

20 Claims, 10 Drawing Sheets

Related U.S. Application Data

(60) Provisional application No. 62/838,425, filed on Apr. 25, 2019, provisional application No. 62/749,399, filed on Oct. 23, 2018.

(56) References Cited

U.S. PATENT DOCUMENTS

| | | | |
|---|---|---|---|
| 2,262,130 | A | 11/1941 | Bagley |
| 3,069,919 | A | 12/1962 | Schultz, Jr. |
| 3,299,766 | A | 1/1967 | Gould et al. |
| 3,389,525 | A | 6/1968 | Moody |
| 4,102,239 | A | 7/1978 | Dallas |
| 4,114,597 | A | 9/1978 | Erb |
| 4,292,876 | A | 10/1981 | De Graan |
| 4,793,757 | A | 12/1988 | Peterson |
| 4,959,938 | A | 10/1990 | De Caro |
| 5,079,055 | A | 1/1992 | Doyle |
| 5,419,666 | A | 5/1995 | Best |
| 5,423,858 | A | 6/1995 | Bolanos et al. |
| 5,517,883 | A | 5/1996 | Goldi et al. |
| 5,541,377 | A | 7/1996 | Stuhlmacher |
| 5,759,001 | A | 6/1998 | Smith |
| 5,803,693 | A | 9/1998 | Choiniere et al. |
| 5,833,422 | A | 11/1998 | Haga et al. |
| D410,869 | S | 6/1999 | Singer |
| 6,039,525 | A | 3/2000 | Johnson |
| 6,212,841 | B1 | 4/2001 | Plume |
| 6,231,063 | B1 | 5/2001 | Chi |
| D482,270 | S | 11/2003 | Derilo |
| 6,665,991 | B2 | 12/2003 | Hasan |
| D517,404 | S | 3/2006 | Schluter |
| 7,090,455 | B2 | 8/2006 | Lamb |
| D549,091 | S | 8/2007 | McIntyre et al. |
| 7,415,803 | B2 | 8/2008 | Bronner |
| D576,480 | S | 9/2008 | Vakiener et al. |
| D596,934 | S | 7/2009 | Vakiener et al. |
| D634,248 | S | 3/2011 | Chen |
| 7,896,380 | B2 | 3/2011 | Tange |
| D644,921 | S | 9/2011 | Hsu et al. |
| D645,337 | S | 9/2011 | Hsu et al. |
| 8,037,653 | B2 | 10/2011 | Hohmann, Jr. |
| D660,691 | S | 5/2012 | Yamazaki |
| D663,243 | S | 7/2012 | Li |
| 8,336,275 | B2 | 12/2012 | Rodenhouse |
| D679,169 | S | 4/2013 | Else |
| D679,572 | S | 4/2013 | Attaway |
| 8,413,740 | B2 | 4/2013 | Rodenhouse |
| D682,666 | S | 5/2013 | Wigboldy |
| 8,516,763 | B2 | 8/2013 | Hohmann, Jr. |
| 8,555,596 | B2 | 10/2013 | Hohmann, Jr. |
| 8,596,010 | B2 | 12/2013 | Hohmann, Jr. |
| 8,601,763 | B2 | 12/2013 | Bui |
| 8,613,175 | B2 | 12/2013 | Hohmann, Jr. |
| D696,930 | S | 1/2014 | Rodenhouse et al. |
| D696,931 | S | 1/2014 | Rodenhouse et al. |
| D696,932 | S | 1/2014 | Rodenhouse et al. |
| 8,661,766 | B2 | 3/2014 | Hohmann, Jr. |
| D702,544 | S | 4/2014 | Hohmann, Jr. |
| 8,726,597 | B2 | 5/2014 | Hohmann, Jr. |
| D706,127 | S | 6/2014 | Hohmann, Jr. |
| 9,140,001 | B1 | 9/2015 | Hohmann, Jr. |
| D744,799 | S | 12/2015 | Rodenhouse et al. |
| D748,973 | S | 2/2016 | Rodenhouse et al. |
| D749,941 | S | 2/2016 | Rodenhouse et al. |
| 9,309,915 | B1 | 4/2016 | Rodenhouse et al. |
| D755,622 | S | 5/2016 | Rodenhouse et al. |
| 9,353,515 | B2 | 5/2016 | Farahmandpour |
| 9,631,667 | B2 | 4/2017 | Rodenhouse et al. |
| D795,685 | S | 8/2017 | Rodenhouse et al. |
| 9,890,807 | B1 | 2/2018 | Rodenhouse et al. |
| 9,945,414 | B1 | 4/2018 | Rodenhouse et al. |
| 9,989,082 | B2 | 6/2018 | Rodenhouse et al. |
| 10,151,103 | B1 | 12/2018 | Hohmann, Jr. |
| 10,202,754 | B2 | 2/2019 | Hohmann, Jr. |
| 2004/0060723 | A1 | 4/2004 | Pallapothu |
| 2004/0084099 | A1 | 5/2004 | Miura |
| 2006/0171794 | A1 | 8/2006 | Ordonio et al. |
| 2007/0011964 | A1 | 1/2007 | Smith |
| 2008/0115439 | A1 | 5/2008 | Tamlyn |
| 2008/0310932 | A1 | 12/2008 | McIntyre et al. |
| 2010/0019014 | A1 | 1/2010 | Rodenhouse |
| 2010/0037552 | A1 | 2/2010 | Bronner |
| 2013/0247498 | A1 | 9/2013 | Hohmann, Jr. |
| 2014/0260065 | A1 | 9/2014 | Hohmann, Jr. |
| 2016/0010325 | A1 | 1/2016 | Hohmann, Jr. |
| 2019/0127970 | A1 | 5/2019 | Hohmann, Jr. |

FOREIGN PATENT DOCUMENTS

| | | | |
|---|---|---|---|
| DE | 102007026733 | A1 | 12/2008 |
| EP | 1510629 | A1 | 2/2005 |
| WO | 2006114177 | A1 | 11/2006 |

OTHER PUBLICATIONS

Brochure disclosing 1-¾" diameter Plasti-Grip® CBW washer distributed by Rodenhouse Inc. more than one year prior to Sep. 6, 2012.

Brochure disclosing 1-¼" diameter Grip-Plate® Tab washer distributed by Rodenhouse Inc. more than one year prior to Sep. 6, 2012.

Brochure disclosing 1-¼" diameter Grip-Plate® Plastic washer distributed by Rodenhouse Inc. more than one year prior to Sep. 6, 2012.

Brochure disclosing 2" diameter Plasti-Grip® CBW2 washer distributed by Rodenhouse Inc. more than one year prior to Sep. 6, 2012.

Brochure disclosing 1-¾" diameter Plasti-Grip® III washer distributed by Rodenhouse Inc. more than one year prior to Sep. 6, 2012.

Brochure disclosing Plasti-Grip® PMF Plastic Masonry Fastener distributed by Rodenhouse Inc. more than one year prior to Sep. 6, 2012.

Brochure disclosing 3" diameter Grip-Lok® "Hurricane" washer distributed by Rodenhouse Inc. more than one year prior to Sep. 6, 2012.

Heckmann Building Products Inc.'s Catalog, Copyright 2001, Effective Jan. 2001; published in 2001.

WALL SYSTEM FASTENER ASSEMBLY FOR BUILDING VENEERS AND CLADDINGS

CROSS REFERENCE TO RELATED APPLICATION

The present application is a continuation of U.S. application Ser. No. 16/661,438, filed Oct. 23, 2019, which claims priority of U.S. provisional application Ser. No. 62/749,399 filed Oct. 23, 2018 and Ser. No. 62/838,425 filed Apr. 25, 2019, which are hereby incorporated herein by reference in their entireties.

FIELD OF THE INVENTION

The present invention is directed to wall system fasteners, and in particular, fasteners for securing of brick or other masonry veneers, insulation attachments, or cladding or girt attachments, such as to insulated cavity walls.

BACKGROUND OF THE INVENTION

Conventional brick anchors may be implemented as wall anchors for insulated cavity walls, such as in buildings utilizing veneer brick walls. A conventional type of veneer brick or masonry wall forms a cavity walls that incorporate an air gap between an "inner" wall and the "outer" veneer. Brick anchors are used in such a construction to secure the outer veneer to the inner wall assembly, such as to a stud.

SUMMARY OF THE INVENTION

Embodiments of the present invention provide a variety of wall fasteners intended for securing exterior coverings to wall systems, such as masonry cavity walls that incorporate an air gap between the face of an air barrier and/or cavity wall insulation (commonly referred to as continuous insulation), and the backside of the masonry veneer (be it traditional brick, block, or stone veneer). These wall fasteners provide several unique benefits. For example, exemplary embodiments provide a thermal break, such that there is no direct metal-on-metal contact, which reduces energy transfer through insulation positioned between an exterior wall covering and an air barrier covered inner wall. Air barrier performance is also improved when the base of an exemplary fastener shank compresses against the air barrier material. There is also less damage to the insulation and the air barrier material, because unlike conventional brick anchors, the fastener shanks are less prone to spinning during installation, which may significantly reduce damage to the insulation and the air barriers. Furthermore, large diameter washers may be configured to affix to the insulation and may also compress the insulation at the point of fastener shank penetration, and thus effectively provide a "gasket" against air and water leakage. Lastly, exemplary embodiments of the present invention provide for improved fire performance. In the event of a fire within the cavity (between the exterior covering and the inner wall), the shank, which may be non-metallic, may melt. However, because of a unique interface where the shank supports a masonry tie or cladding support, the anchor or support may be still retained by the large diameter head of a flat head screw inserted into the shank and secured to the wall.

In an aspect of the present invention, a wall anchor for retaining a brick veneer alongside a wall includes an elongated tubular shank, a washer, and an masonry tie, such as a wire tie, pintle, or plate anchor. The shank is configured to provide a space for a layer of insulation between the brick veneer and the wall. The shank comprises a center bore running down the length of the shank and is configured for receiving a screw through the bore for securing the wall anchor to the wall. The shank also includes a pair of flanges positioned on a proximal or non-penetrating end of the shank. The pair of flanges are configured to form a groove between them. The washer is configured with a central portion comprising a center hole configured for receiving the shank. The washer's central portion is configured for supporting the pair of flanges when the screw is inserted into the wall. The washer may include a raised annular rim configured to support and retain the pair of flanges. The annular rim may be configured to retain and support the inner flange of the pair of flanges. The masonry tie includes a portion configured to be retained by the groove. The masonry tie is configured for inserting between rows of bricks of the brick veneer. The length of the shank may be selected according to the thickness of the layer of insulation.

The washer is configured to compress and support the layer of insulation when the fastener assembly is secured to the wall. The washer may include spiked projection on the underside of the washer to retain the insulation and to enable pre-spotting of the washer onto the surface of the layer of insulation. The shank and the pair of flanges are unitarily formed of a non-metallic material, such as polycarbonate, polyurethane, or a similar polymer or co-polymer. The screw and masonry tie are each unitarily formed of metal, such as a stainless metal or a metal coated with a corrosion resistant coating. The outer flange of the pair of flanges may include a raised annular ring configured to make first contact with an underside of the head of the screw when the screw is driven into the wall. The raised annular ring on the flange is a "crush" ring that compresses or crushes under the head of the screw and effectively forms a seal between the screw and the flange.

In another aspect of the present invention, unlike conventional brick anchors which require a wire tie to be pulled apart or opened such that the wire tie may be inserted through an "eye" protruding from the extending end of the conventional brick anchors, the exemplary angled wire tie of the present invention is configured to be retained by sliding the narrow portion of the wire tie over and into the groove without the need for pulling the wire tie apart.

In yet another aspect of the present invention, the screw is inserted into the wall with a conventional screwdriver bit coupled to a driver. In a further aspect of the present invention, the screw is a large diameter flat head screw.

In another aspect of the present invention, the shank includes an integrated wedge seal that extends around the outer diameter of the shank. The wedge seal may be defined as a conical shape with a wide portion of the wedge seal having a diameter that is at least larger than the outer diameter of the shank. The wedge seal is located along the shank based on the thickness of sheathing to be used with the wall assembly whereby the wedge seal is positioned at the barrier sheet when the end of the shank is pressed against the stud. When the screw of the fastener assembly is tightened, the tapered conical surface of the integrated wedge seal wedges into and compresses against the barrier sheet to effectively seal the penetration of the shank through the barrier sheet, such as against water.

In another form of the present invention, a wall fastener assembly for retaining an exterior wall covering alongside a wall system includes an elongated, tubular shank configured to provide a space for a layer of insulation between the exterior covering and an inner wall of the wall system. The shank defines a center bore extending along the length of the shank and is configured for receiving a screw configured to secure the wall fastener assembly to the wall. The shank comprises a pair of flanges positioned on a proximal, non-penetrating end of the shank. The pair of flanges are configured to form an annular groove between them. A washer is included that is configured with a central portion defining a center hole for receiving the shank. The central portion is configured for supporting the pair of flanges when the screw is inserted into the wall. The wall fastener assembly includes an elongated, semi-rigid, tubular seal that defines a center bore extending along the length of the tubular seal. The center bore is configured for receiving either of the shank or the screw. The tubular seal is configured to compress at one end against the wall and at the opposite end against an underside of the washer.

The wall system may include an air, vapor, fluid, or weather barrier and the tubular seal is configured to compress against the barrier to effectively form a seal between the wall fastener assembly and the barrier. In one aspect, the length of the tubular seal may be selected according to the thickness of the layer of insulation. In another aspect, the length of the shank may be selected according to a combined thickness of the layer of insulation and a wall board, wherein the shank is configured to pass through the insulation and the wall board. The shank may pass through the insulation and the wall board and abut a stud of the wall system. In yet another aspect, the length of the tubular seal is substantially equal to the length of the shank minus the thickness of the wall board, such that when the shank passes through the insulation, the tubular seal compresses against the wall board. In one aspect, the central portion of the washer includes a raised annular rim for compressively mating with the tubular seal.

In another aspect, the wall fastener assembly includes a wire tie having a narrow portion configured to be retained by the groove, wherein the wire tie is configured for inserting between rows of masonry of the masonry veneer. In yet another aspect, the outer flange of the pair of flanges includes a raised annular ring configured to make first contact with an underside of the head of the screw when the screw is driven into the wall.

In one aspect, the wall fastener assembly is provided for securing a track of a girt alongside a wall. The girt is secured to the wall by the wall fastener assembly. A hole drilled in a portion of the girt is configured to be retained by the groove defined between the pair of flanges.

In another form of the present invention, a wall fastener assembly for retaining a girt alongside a wall includes a screw configured to secure the wall fastener assembly to the wall and an elongated, semi-rigid, tubular seal. The tubular seal defines a center bore extending along the length of the tubular seal, the center bore is configured for receiving the screw. The wall fastener assembly secures the girt alongside the wall. The tubular seal is configured to compress at one end against the wall and at the opposite end against a portion of the wall fastener assembly proximate a non-penetrating end of said wall fastener assembly, such as against the head of the screw.

In one aspect, the wall fastener assembly includes an elongated, tubular shank configured to provide a space for a layer of insulation between the girt track and an inner wall of a wall system. The shank defines a center bore extending along the length of the shank, the center bore configured for receiving the screw. The shank includes a pair of flanges positioned on a proximal, non-penetrating end of the shank and the pair of flanges are configured to form an annular groove between them. The track of the girt includes a hole drilled in a portion of the girt, the hole configured to be retained by the groove between the pair of flanges.

Therefore, a wall fasteners assembly is provided for retaining an exterior wall covering alongside a wall or a wall system. The wall fastener assembly may be adapted to secure masonry veneers to a cavity wall system while a layer of insulation is retained between the masonry veneer and the wall. The wall fastener assembly may be adapted to secure a girt system to a wall or a wall system. The wall fastener assembly may include seals, rims, and other features in order to provide air and vapor tight seals between the fastener assembly and various wall materials, such as air and vapor barriers, gypsum sheathing, and wood or metal studs. The wall fastener assembly may provide improved thermal insulation, reduced damage to other materials or surfaces, resists air and water flow, and can retain an exterior wall covering even in the event of fire.

These and other objects, advantages, purposes and features of the present invention will become apparent upon review of the following specification in conjunction with the drawings.

DESCRIPTION OF THE PREFERRED EMBODIMENTS

Figure 1:
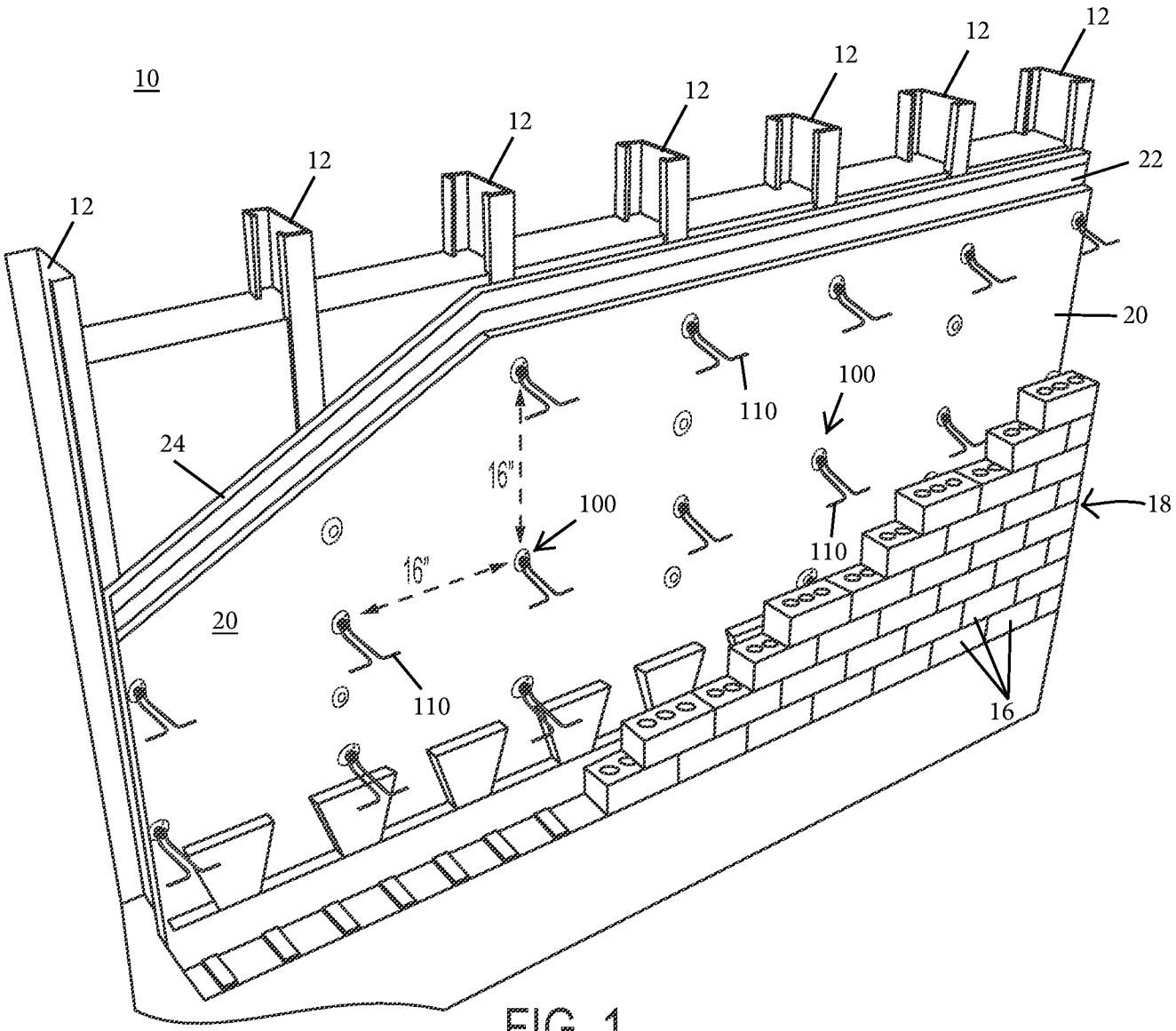
FIG. 1 is a perspective view of a wall system with a plurality of wall system fastener assemblies in accordance with an embodiment of the present invention.

Referring to the drawings and the illustrative embodiments depicted therein, exemplary wall system fastener assemblies for fastening various wall coverings and claddings to wall systems may be implemented in any one or more of the illustrative embodiments discussed herein. Wall coverings and claddings include various masonry veneers 18 and girt systems 30. An exemplary masonry cavity wall incorporates an air gap between the face of an air barrier 22 and/or cavity wall insulation 20 (commonly referred to as continuous insulation), and the backside of the masonry veneer 18 (be it traditional brick, block, or stone veneer). The wall fastener assemblies of the present invention provide a variety of improvements and benefits. For example, exemplary embodiments provide a thermal break, such that there is no direct metal-on-metal contact. The exemplary embodiments may also result in reduced damage to the insulation 20 and the air barrier material 22 during installation, because unlike conventional barrel veneer anchors, tubular shanks 120 of the fastener assemblies described herein are inhibited from spinning during installation. Furthermore, as described herein, these wall fastener assemblies may also include exemplary large diameter washers 140 that are configured to compress against the rigid or semi-rigid insulation 20 to form a seal around the point of fastener penetration into the insulation, as well as provide a seal with a flange of the tubular shank 120. Lastly, exemplary embodiments of the present invention may provide for improved fire performance. In the event of a fire, even if a non-metallic tubular shank 120 of a wall fastener assembly melts, an exemplary masonry, stone, or cladding anchor 110 may remain retained by the large diameter head 108*a* of the flat head screw 108 inserted into the tubular shank 120 and secured to the wall.

In the illustrated embodiment of FIG. 1, a wall system 10 includes a plurality of wall fastener assemblies 100 in spaced arrangement along a wall of a building. The fastener assembly 100 of FIG. 1 includes a threaded fastener 108 and a masonry tie 110 disposed proximate a head 108*a* of the threaded fastener 108. While the masonry tie 110 in the exemplary embodiments is shown as a wire, it will be appreciated that the masonry tie 110 may be other forms of masonry or cladding anchors, including pintles and plate anchors. During construction, the wire tie 110 is disposed in the wet mortar joint between two rows of bricks 16 of a masonry veneer 18 and the wire tie 110 is configured to engage the mortar joint to secure the masonry veneer 18 to the wall system 10 via engagement of the fastener 108 with a stud 12 of the wall system 10 while leaving an air gap between the veneer 18 and the inner wall. Each fastener assembly 100 is thus located corresponding to a location of a stud 12 of the wall system 10 and a mortar joint of the masonry veneer 18. A layer of continuous insulation 20 is disposed between the masonry veneer 18 and the studs 12. Additionally, layers of air barrier 22, gypsum sheathing 24, or other wall or insulating materials may be disposed between the studs 12 and the masonry veneer 18.

Figure 2:
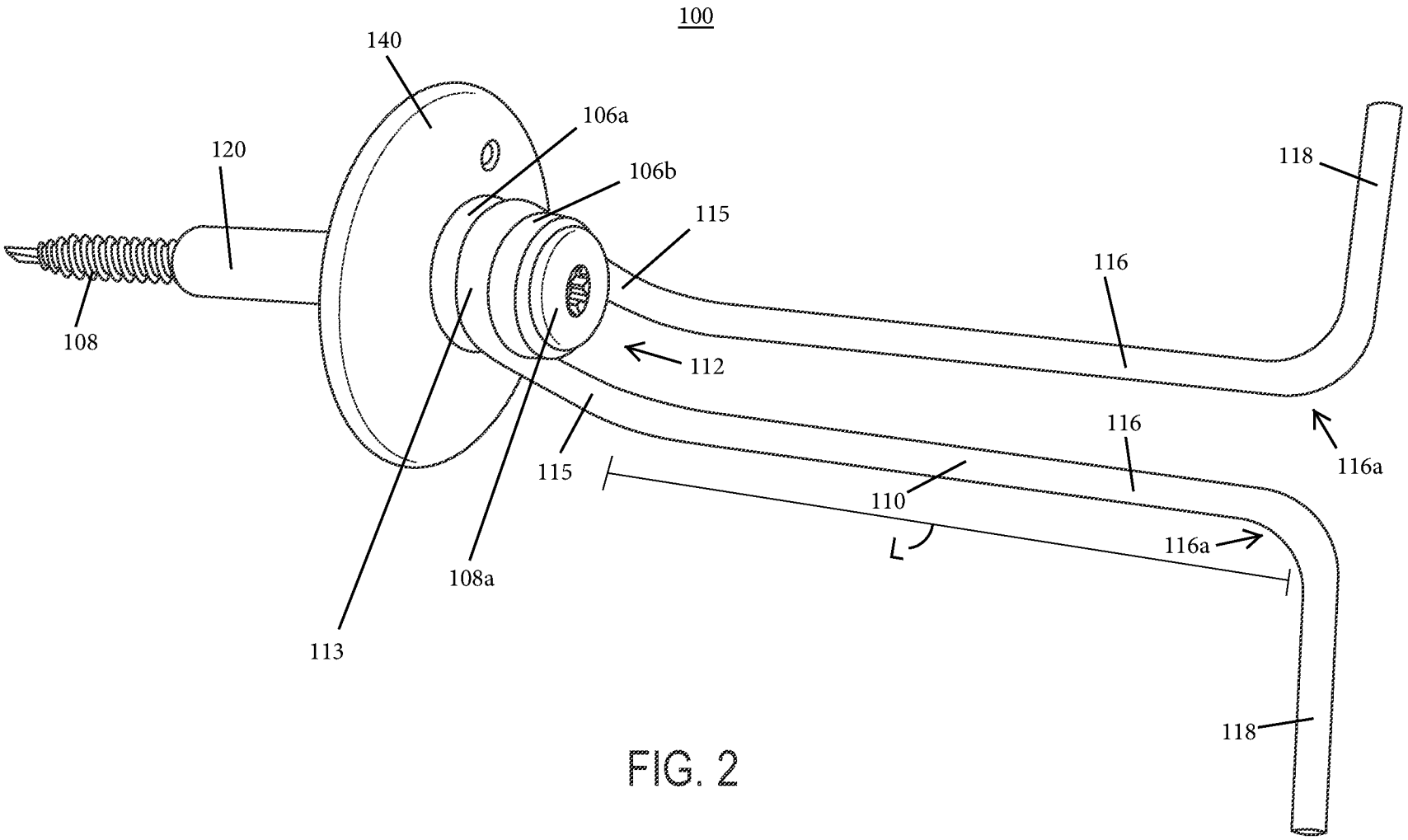
FIG. 2 is a perspective view of a wall fastener assembly of FIG. 1.

FIG. 2 illustrates an exemplary wall fastener assembly 100 configured for installation in cavity walls. As illustrated in FIGS. 1-4A, the embodiment of the wall fastener assembly 100 is configured for retaining an insulation layer 20 between the exterior wall covering, such as a masonry veneer 18, and an inner wall. Such inner walls may be any one of steel or wooden studs 12 (see FIG. 4). In alternative embodiments, the inner wall may additionally include masonry, gypsum sheathing overlays, air barriers, vapor barriers, or other substrates (see FIG. 5). The fastener assembly 100 includes a non-metallic tube or tubular shank 120 with a pair of generally disc-like flanges disposed on a proximal or non-penetrating end, with the flanges including an inner flange 106*a* and an outer flange 106*b* and forming an annular groove 107 therebetween. As illustrated in FIG. 2, an exemplary shank 120 may be formed of a rigid non-metallic material with an elongated tubular construction and a center bore 121 running down the length of the shank 120. The non-metallic material may be polycarbonate, polyurethane, or a similar polymer or co-polymer. The center bore 121 is configured for receiving the threaded fastener 108 that includes a large diameter head 108*a*. The fastener assembly 100 also includes a washer 140 having a planar bottom portion with a raised annular ridge or rim portion 240 surrounding a central annular cavity 238 that is configured for receiving the inner flange 106*a* of the shank 120. As illustrated in FIG. 2, the central cavity 238 of the flat washer 140 has a centered through hole 236. Optionally, the washer 140 may include spiked projections 142 (see FIGS. 8-8C) for insertion in rigid insulation for pre-spotting or self-retention of the washer 140 during assembly.

The exemplary fastener assembly 100 is configured to reduce thermal transfer through the wall at the fastener 108, with the materials for the fastener assembly 100 being chosen to maximize energy efficiency and reduce energy transfer. The rigid material of the tubular shank 120 may be a resinous plastic, such as polycarbonate or a fiber reinforced plastic. The end of shank 120 may be provided with a sharpened or pointed end 120*a* to cut or pierce through the insulation 20, vapor barrier 22, and/or gypsum sheathing 24 while reducing damage to the insulation 20 and other substrates that is typically caused by conventional fasteners during installation. For example, in the embodiment of FIG. 4, a barrier sheet 22 comprising a weather barrier or air barrier is disposed over the insulation 20 on the side opposite stud 12, with the barrier sheet 22 then being disposed between the insulation 20 and washer 140 when fastener assembly 100 is affixed to the wall assembly 10.

Flanges 106*a*, 106*b* may have the same thicknesses. Alternatively, the flanges 106*a*, 106*b* may have different thicknesses. For example, the flange 106*b* proximate the head 108*a* of the flat head screw 108 may be thicker to strengthen the flange 106*b* to prevent crushing from the screw head 108*a* as the screw 108 is tightened (see FIGS. 4 and 5). The flanges 106*a*, 106*b* may also have the same diameter, or alternatively may have different diameters, i.e. the inner flange 106*a* proximate the washer 140 may have a larger diameter than the flange 106*b* proximate the head 108*a* of the flat head screw 108 (not shown). Optionally, such a larger diameter flange 106*b* may take the place of the washer 140 and perform the same function.

The fastener assembly 100 is configured such that once the tubular shank 120 and washer 140 have been placed against the exposed portion of the wall, a screw 108 is inserted into the bore 121 of shank 120. The screw 108 may then be driven into the stud 12 behind the insulation 20, with the end 122 of the tubular shank 120 then being in pressed engagement to the stud 12. The screw 108 may be driven into the wall 10 via any available driver means, such as an electric drill equipped with a screwdriver bit. Other means for driving the screws 108 into the wall may also be used. It is also noted that such an arrangement that makes use of a conventional screwdriver bit is an advantage over conventional wall anchors which often require the use of a proprietary chuck adapter that is configured to receive such wall anchors. Such an arrangement also requires the entire anchor to spin when the anchor is attached to a wall or substrate, thus potentially damaging the insulation 20.

Once the screw 108 has been driven through the air barrier 22 and into the stud 12 of wall 10 such that screw head 108*a* is pressed against the outer flange 106*b*, the inner flange 106*a* will be tightly pressed against the washer 140, with the inner flange 106*a* resultantly pressing against the central cavity 238 of the washer 140, and with the raised portion 240 of the washer 140 surrounding an outside surface of the inner flange 106*a*.

Figure 3:
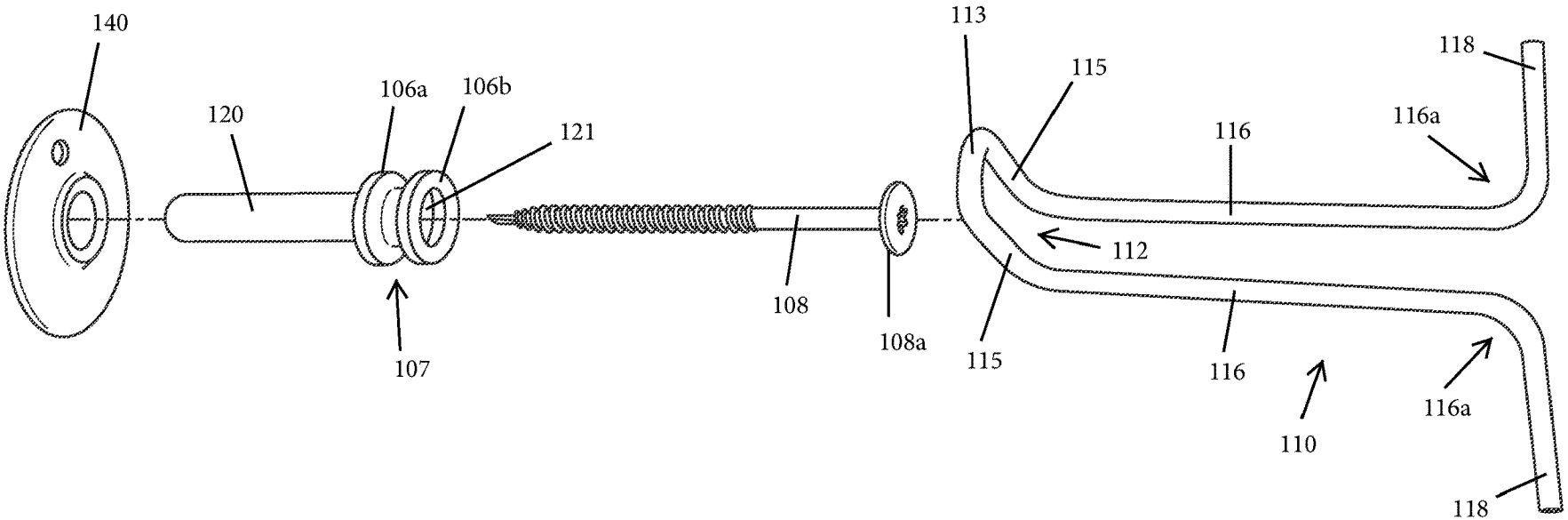
FIG. 3 is an exploded perspective view of the wall fastener assembly of FIG. 2.

As illustrated in FIGS. 1-3, the fastener assembly 100 includes a wire tie 110 installed onto the non-penetrating end of the fastener assembly 100. An opening forming a throat 112 in the illustrated wire tie 110 embodiment is formed between the narrow, parallel portions 115 of the wire tie 110, and forms a U-shaped bend 113 configured to nest or rest within the groove 107 between the flanges 106*a*, 106*b*. Such an installation is unlike the process required for conventional brick anchors, where a wire tie must be pulled apart or opened so that the wire tie may be inserted through an "eye" protruding from the extending end of the conventional brick anchor. Embodiments of the present invention therefore have an advantage over conventional brick anchors. For example, conventional brick anchors require an installer to use two hands to open the wire tie, insert an end of the wire tie into the eye, and then rotate the wire tie until properly orientated. In contrast, embodiments of the present invention merely require the wire tie 110 to be slipped over and into the groove 107 with a single hand. Furthermore, because the narrow throat 112 of the wire tie 110 is retained between the flanges 106*a*, 106*b* of the tubular shank 120, in the event of a fire, even if the non-metallic portions of fastener assembly 100 melt, such as a plastic tubular shank 120 and washer 140, the wire tie 110 may still be retained on the large diameter flat head 108*a* of the screw 108, which may provide additional safety during any evacuation of a building using such veneer construction. The preferred embodiment of the screw 108 thus includes a large diameter flat head 108*a*. The screw 108 and the wire tire 110 can be any combination of dissimilar metals without causing galvanic corrosion because the flanges 106*a*, 106*b* of the tubular shank 120 prevent the screw 108 and wire tie 110 from contacting each other after proper installation of the wall fastener assembly 100.

The exemplary masonry tie wire tie 110 of FIG. 1-3 is formed from a single wire that is bent or formed to be generally L-shaped and includes perpendicular extension legs 116 extending substantially perpendicularly from each of the parallel leg portions 115 of the narrow throat 112, with the legs 116 thus configured to extend from the narrow throat 112 toward the masonry veneer 18 when mounted to the tubular shank 120. The extension legs 116 have an extension length L defined from the narrow throat 112 to ends 116*a* of the extension legs 116. The extension length L may be chosen as a function of various factors, including the width of the masonry veneer 18 and the desired penetration of the wire tie 110 into the masonry veneer 18, as well as the desired air gap between the masonry veneer 18 and the inner wall. Perpendicular tips 118 extend substantially perpendicularly from the ends 116*a* and are oriented substantially coplanar with the extension legs 116 such that when portions of the extension legs 116 and tips 118 are disposed in the mortar joint, legs 116 and tips 118 are substantially coplanar with the mortar joint.

Figure 4:
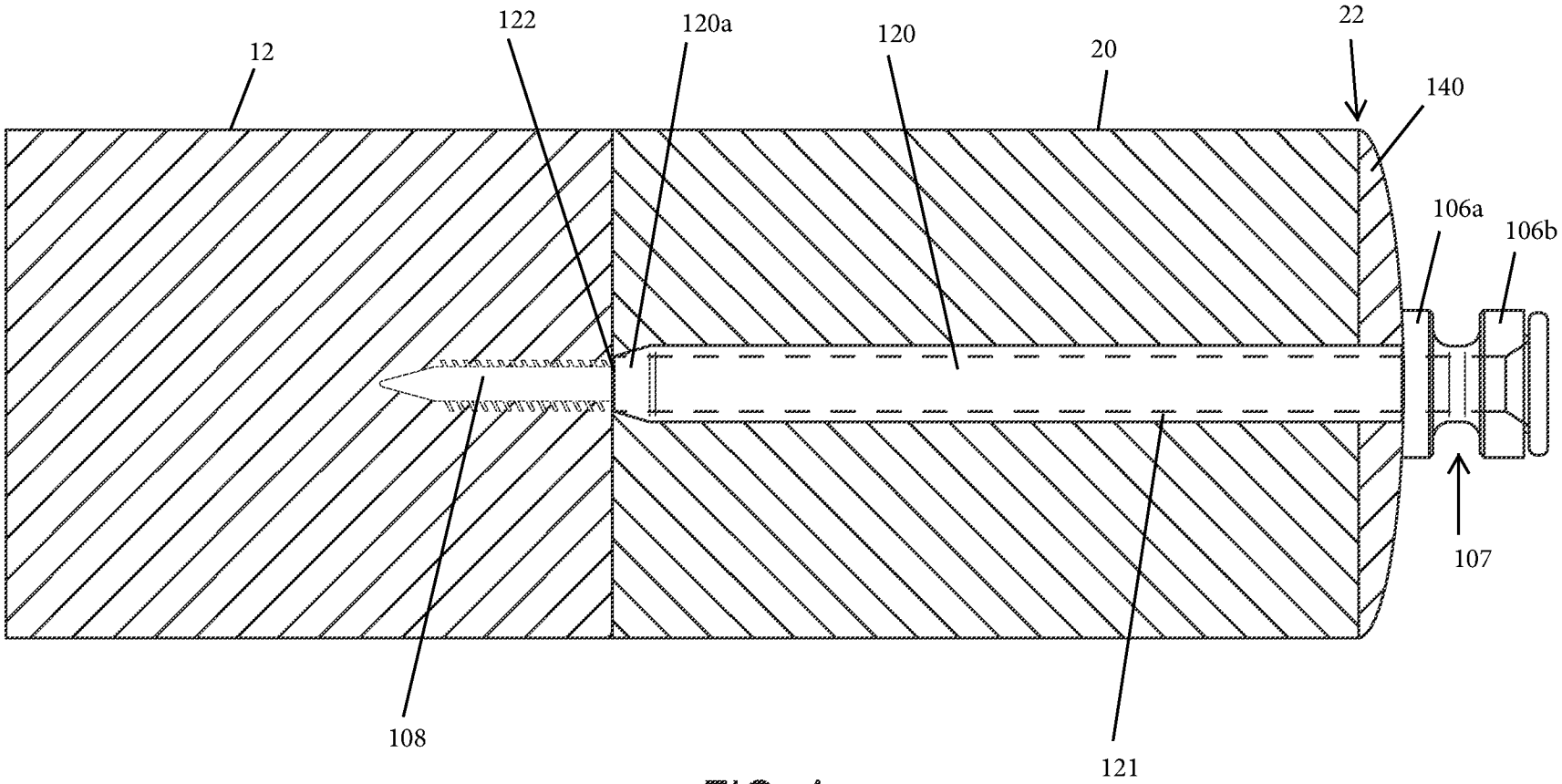
FIG. 4 is side cross-sectional view of a portion of the wall system and a wall fastener assembly of FIG. 1.

Once the narrow throat 112 of the wire tie 110 has been disposed on the groove 107, the wire tie 110 may be rotated in any orientation desired. In the illustrated embodiment, because of the narrow throat 112 of the wire tie 110, the wire tie 110 may be rotated or moved approximately 1.25 inches above or 1.25 inches below the head 108*a* of the screw 108, and thus ensuring that the wire tie 110 can be placed into a wet mortar joint while the wire tie 110 remains secured to the tubular shank 120. As illustrated in FIG. 4, a length of the tubular shank 120 is selected to match a thickness of insulation 20. When the length of the shank 120 matches the thickness of the insulation 20, the end 122 of tubular shank 120 will "bottom out" on the surface of the stud 12. By "bottoming out" the shank 120 on the surface of the stud 12, the hole created by the screw 108 when it passes through the stud 12 will be sealed or covered by the bottom 122 of the shank 120. That is, when the screw 108 is tightened, the end 122 of the tubular shank 120 compresses against the stud 12 to effectively seal the penetration by the screw 108 against air and water.

Figure 9:
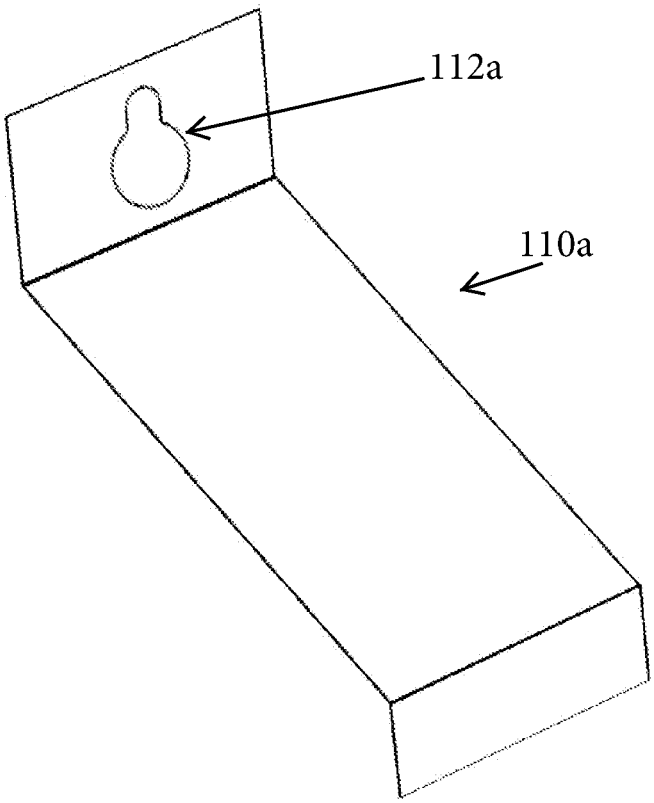
FIG. 9 discloses an alternative masonry tie for use with wall fastener assemblies in accordance with aspects of the present invention.

It should be appreciated, as noted above, that alternative masonry or cladding anchors may be used other than the wire tie 110 disclosed in FIGS. 1-3. For example, as shown in FIG. 9 an alternative anchor 110*a* is disclosed that is constructed of a stamped and bent plate or sheet member, with anchor 110*a* having a slotted key hole opening 112*a*. Opening 112*a* is configured to be mounted over outer flange 106*b* and positioned within groove 107 between flanges 106*a*, 106*b* of tubular shank 120, whereby the extending portion is disposed within the masonry joint of the veneer wall.

Figure 5:
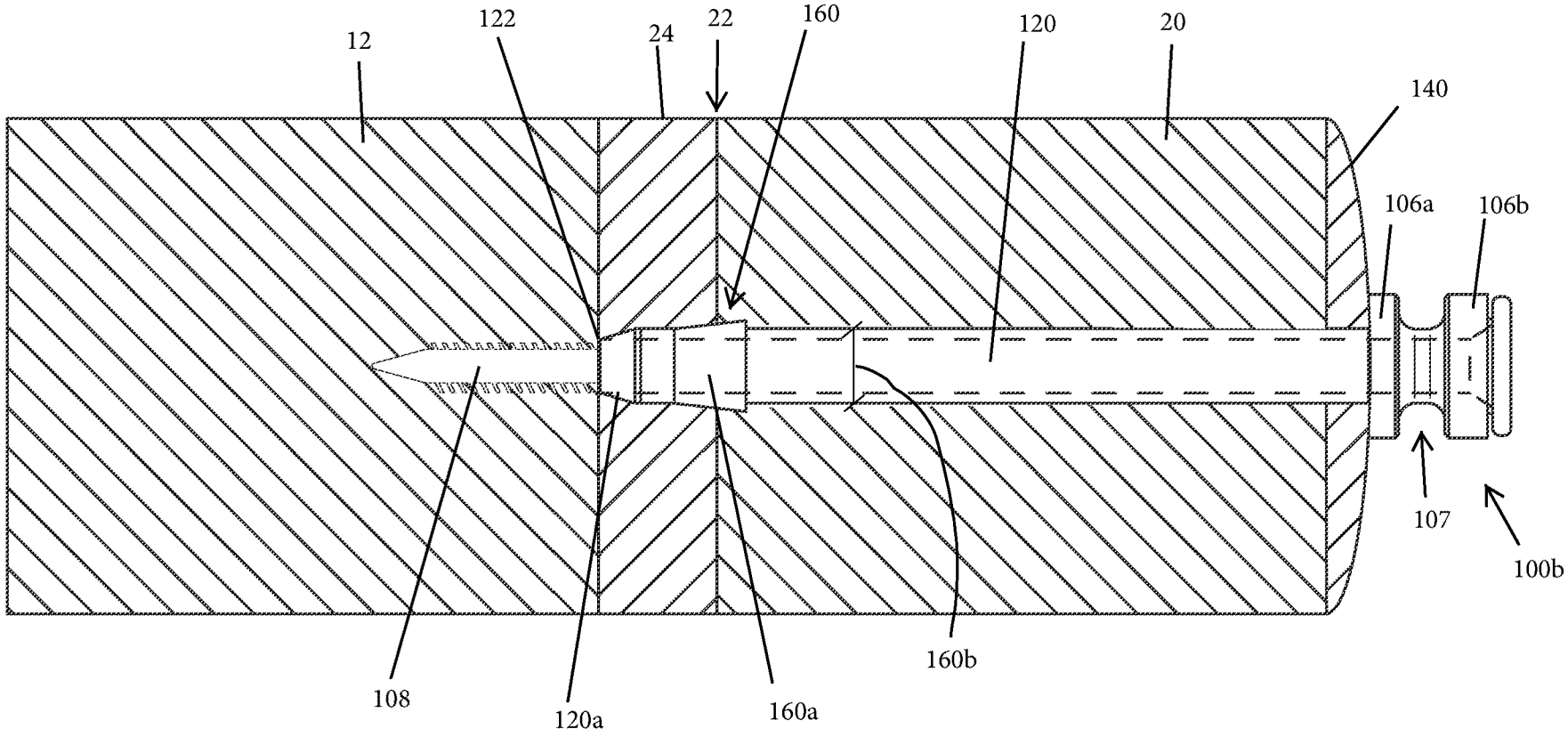
FIG. 5 is a side view of a portion of an alternative wall fastener assembly for use with an alternative wall system in accordance with another embodiment of the present invention.

As illustrated in FIGS. 1, 4, and 5, and discussed herein, the wall may be constructed to include steel or wood studs 12. The wall may also include, for example, an overlayer of exterior gypsum sheathing 24 or other substrate disposed over the studs 12. In these scenarios, compression and tension loads may be transferred through the tubular shank 120 and screw 108 and to the wall, and in particular the studs 12, for long term fastening of the masonry veneer 18 via the wire ties 110. The fastener assembly 100 and the masonry veneer 18 are formed such that two rows of bricks of the brick veneer will sandwich and retain the wire ties 110 when they are embedded in a mortar joint between the two rows of bricks 16, or other such masonry cladding.

As noted, in the embodiment of FIG. 4, a barrier sheet 22 is disposed on the exterior of the insulation 20 and the washer 140 compressively contacts the barrier sheet 22 when the screw 108 is tightened. The contact between the washer 140 and the barrier sheet 22 effectively seals the wall fastener assembly 100 at the barrier sheet 22. As discussed in more detail below, in the embodiment of FIG. 5, a sheet of vapor barrier 22 is disposed on the interior side of the layer of insulation 20 between the insulation 20 and a gypsum sheathing 24 that is attached to the studs 12. The end of the shank 120 is provided with a sharpened or pointed end 120*a* to cut or pierce through the insulation 20, as well as to cut through any air or vapor barrier 22 and gypsum sheathing 24, with the end 122 of the tubular shank 120 then abutting directly against the stud 12. The pointed end 120*a* pierces through the substrates instead of auguring through the substrates which is typical of conventional fasteners and shanks. As discussed below with reference to the embodiment of FIG. 5, the shank 120 may include a seal portion 160 to contact the vapor barrier 22 and effectively seal the shank 120 against the vapor barrier 22. In an optional embodiment, not shown, the shank 120 does not extend through the vapor barrier or the gypsum sheathing, but instead abuts the gypsum sheathing with the vapor barrier disposed between the end of the shank 120 and the gypsum sheathing, wherein the end of the shank effectively seals with the vapor barrier.

An exemplary washer 140 is described in commonly assigned U.S. Pat. Nos. D682,666 and 9,309,915 which are each hereby incorporated herein by reference in their entireties. Washer 140 includes a pair of prongs or arms 142*a*, 142*b* extending or projecting from backside or underside 246 of washer 140 (FIGS. 8A-8D). Prongs 142*a*, 142*b* may be pressed into a building material surface, such as foam insulation, to aid in retaining or pre-spotting the washer 140 in place during assembly of fastener 100 to the building. For example, as illustrated in FIG. 8D, prongs 142*a*, 142*b* may be pressed through a barrier sheet 22 and into a foam insulation layer 20 to retain the air barrier sheet 22 and/or washer 140 in place prior to or during affixing of fastener 100 to a rigid portion of the wall system 10, where the rigid portion may comprise a metal stud 12 for example.

Accordingly washer 140 is plastic and is shown to include a solid upper or outer surface or upper wall 234, a central aperture 236 extending through washer 140, and a recess or cavity 238 in outer surface 234 (FIGS. 8A-8D). Cavity 238 includes a wall 240 formed as a cylindrical bore that forms an opening 242 in outer surface 234, where the cylindrical bore 240 has a diameter greater than aperture 236 and does not extend through washer 140 to thereby form a seat 244 (FIG. 8A) Accordingly the inner flange 106 of the fastener assembly 100 is able to be received within seat 244 when shank 120 and screw 108 are assembled to washer 140.

Figure 8A:
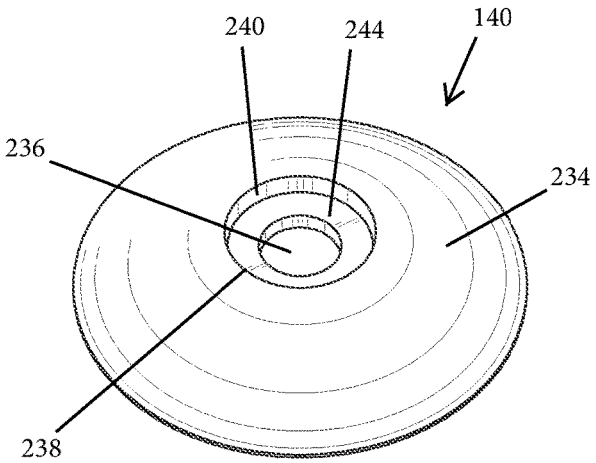
FIG. 8A is a top perspective view of a washer of the wall fastener assembly of FIG. 2.
Figure 8B:
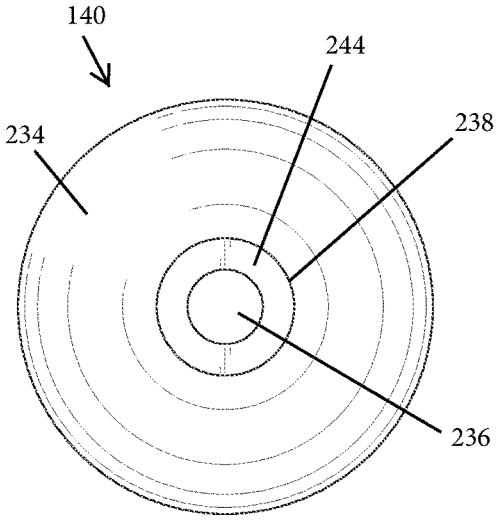
FIG. 8B is a top view of the washer of FIG. 8A.
Figure 8C:
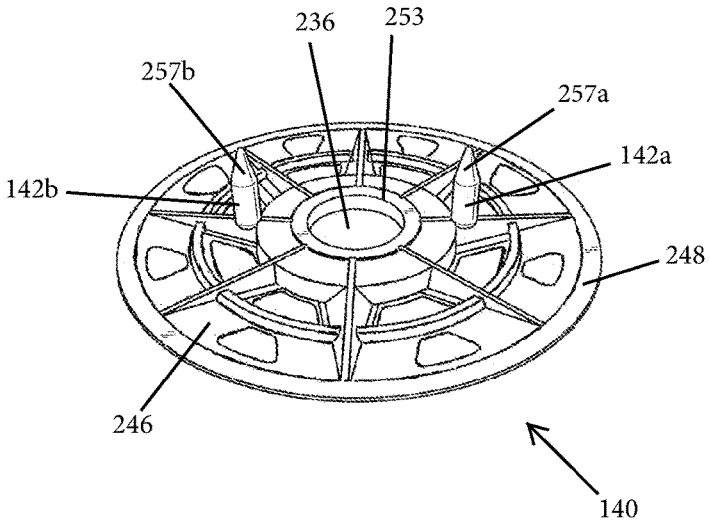
FIG. 8C is a bottom view of the washer of FIG. 8A.
Figure 8D:
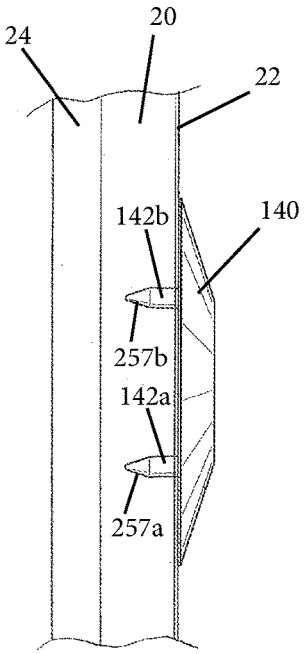
FIG. 8D is a side elevation view of the washer of FIG. 8A.

In the illustrated embodiment, washer 140 includes two projections or prongs or arms 142*a*, 142*b* that extend downwardly from the underside 246 of washer 140 by about approximately 0.25 inches (FIGS. 8C and 8D). The arms 142*a*, 142*b* are diametrically opposed relative to each other and include angled tips 257*a*, 257*b* to form sharpened points for puncturing and/or penetrating building materials, such as an air or vapor barrier sheet or a pliable construction material. The location of arms 142*a*, 142*b* within or between the outer sealing circumference 248 and inner sealing surface 253 aid in inhibiting moisture and/or air from reaching arms 142*a*, 142*b*. It should be appreciated that alternative arrangements of arms may be employed. For example, an alternative washer may be constructed to include a single arm or more than two arms, or alternatively spaced or shaped arms, although the use of two or more arms aids in preventing rotation of washer 140 upon installation. Still further, it should be appreciated that alternatively configured and arranged washers may be employed with the fastener assemblies of the present invention, including washers without mounting prongs.

Figure 4A:
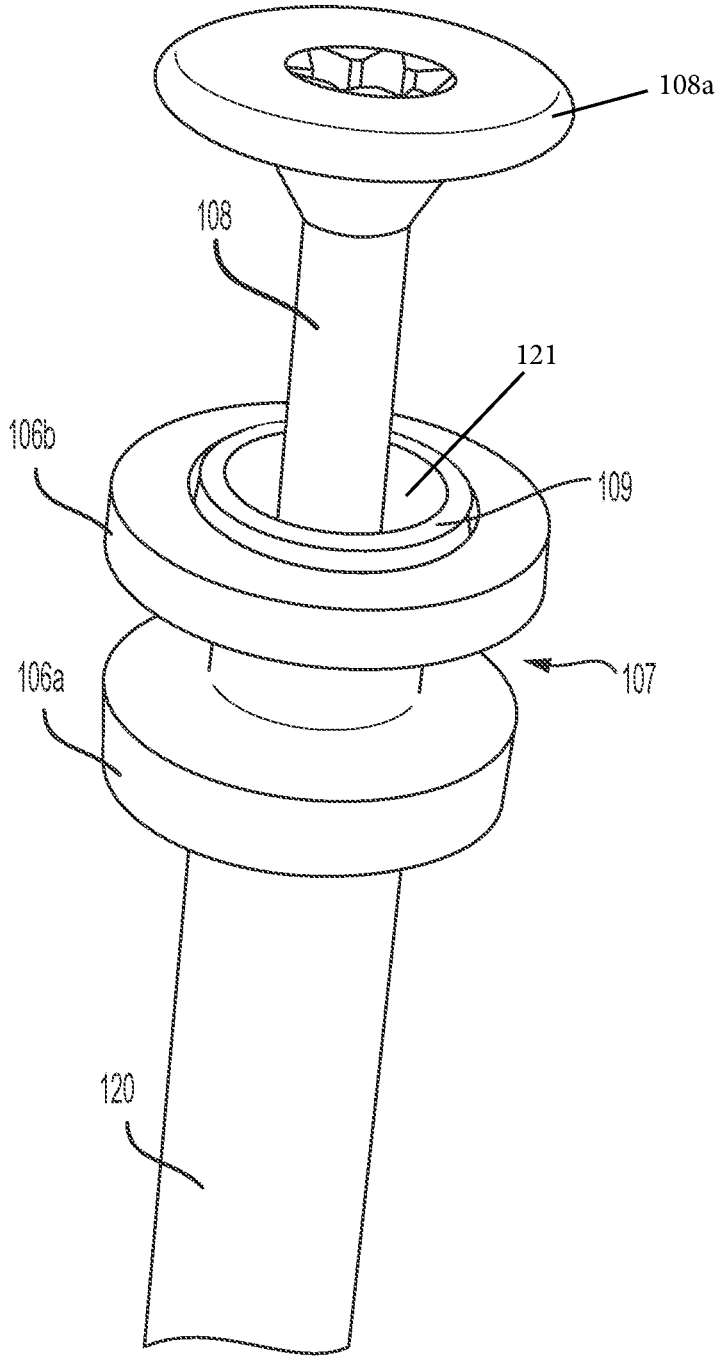
FIG. 4A is a perspective view of a portion of the wall faster assembly of FIG. 4.

With reference to FIG. 4A, in the illustrated embodiment of tubular shank 120 at the top portion of the outer flange 106*b* a sealing or crush ring 109 is provided. The crush ring 109, as the screw 108 is tightened, will make first contact with the underside of the screw head 108*a*. The crush ring 109, formed as a thin annular band or ring of plastic/nylon, will be malleable such that the crush ring 109 will "crush," creating a seal against air and water penetration between the flange 106 and the screw head 108*a*. Alternatively and/or additionally, an optional neoprene/epdm/rubber gasket, such as an O-ring or the like, may be placed between the screw head 108*a* and the outer flange 106*b*. Still further, a similar sealing or crush ring (not shown) may optionally additionally or alternatively be disposed on the bottom side of the opposite flange 106*a*, where such a crush ring contacts and seats against the washer 140, and in particular within the annular region 238, to thereby promote sealing between the inner flange 106*a* and washer 140. Similarly, an O-ring may optionally or alternatively be used between the inner flange 106*a* and the washer 140.

As illustrated in FIG. 5, an alternative embodiment of a wall fastener assembly 100*a* is shown that is of substantially similar construction to wall fastener assembly 100. As such, like numbered reference numerals are used in the discussion of fastener assembly 100*a* as are used in connection with wall fastener assembly 100 disclosed in FIGS. 1-4A. The inner wall assembly of FIG. 5 additionally includes a layer of gypsum sheathing 24 disposed between the stud 12 and insulation 20, with a barrier sheet 22 disposed between the insulation 20 and gypsum sheathing 24.

As shown in FIG. 5, fastener assembly 100*a* includes a wedge gasket or seal 160 that is integrated onto the tubular shank 120 of the fastener assembly 100*a*. In the illustrated embodiment, the integrated wedge seal 160 extends around the outer diameter of the tubular shank 120 and includes a wide portion with a diameter that is at least larger than the outer diameter of the shank 120, and is tapered inwardly toward the outer diameter of the shank 120 relative to the insertion direction to form a frustoconical wedge seal 160. The wedge seal 160 is positioned along the length of the shank 120 based on the thickness of the gypsum sheathing 24 that is to be used with the wall assembly whereby the wedge seal 160 is positioned at the barrier sheet 22 when the end 122 of tubular shank 120 is pressed against the stud 12. The integrated wedge seal 160 thus provides an air or vapor seal between the shank 120 and the barrier sheet 22. The integrated seal 160 may be integrally formed with the shank 120 such as by molding. When the screw 108 of the fastener assembly 100 is tightened, the tapered conical surface of the integrated wedge seal 160 wedges into and compresses against the barrier sheet 22 to effectively seal the penetration of the shank 120 through the barrier sheet 22, such as against water. Optionally, an integrated fluid seal 160*a* is conically shaped with the smaller diameter of the conical shape facing toward the tip of the screw 108, as shown in FIG. 5. Alternatively, the integrated fluid seal is conically shaped with the smaller diameter of the conical shape facing toward the head of the screw 108 (not shown). As the integrated fluid seal 160*a* is inserted through the insulation 20, the wider portion of the fluid seal 160*a* forms an at least partially wider hole through the insulation than the outer diameter 160*b* of the remainder of the shank 120. The at least partially wider hole reduces friction between the shank 120 and the insulation 20 during installation, resulting in reduced force required to insert or install the shank 120 through the insulation 20 and reducing damage to the insulation 20 because of the reduced friction.

Figure 6:
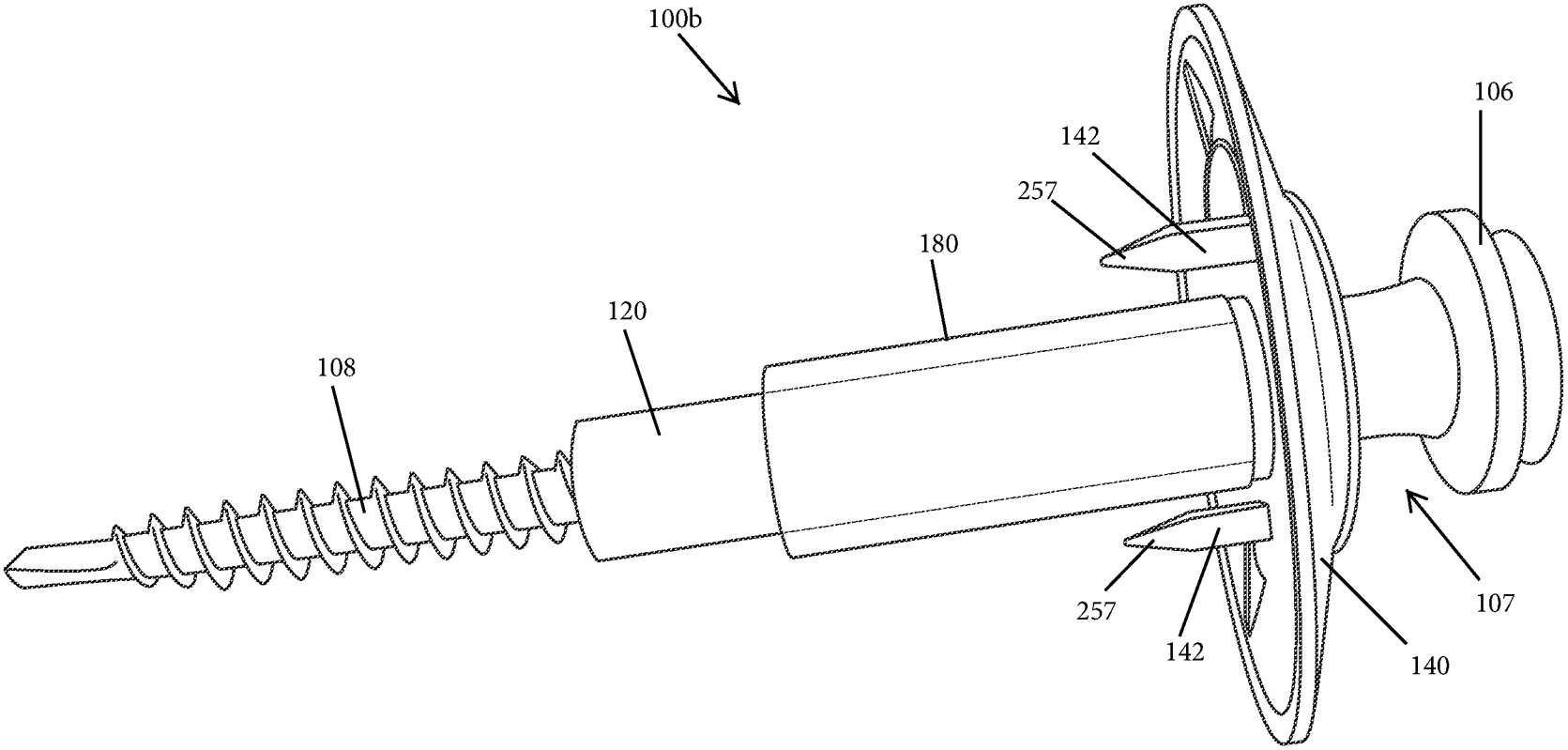
FIG. 6 is a perspective view of a still further wall fastener assembly in accordance with another embodiment of the present invention.

Referring now to FIG. 6, yet another alterative fastener assembly 100*b* is disclosed, where fastener assembly 100*b* is substantially similar to assemblies 100 and 100*a* discussed above. As such, like numbered reference numerals are used in the discussion of fastener assembly 100*b* as are used in connection with wall fastener assembly 100 disclosed in FIGS. 1-4A and assembly 100*b* disclosed in FIG. 5. In the exemplary embodiment illustrated in FIG. 6, a fluid or tube seal 180 is disposed over the body of the tubular shank 120 of the wall fastener assembly 100. The fluid or tube seal 180 is formed from a semi-rigid material, such as flexible polyvinyl chloride, a polyurethane, or a similar polymer or co-polymer. Optionally, the tube seal 180 may be injection molded or extruded and include properties such as UV inhibition, high and low temperature resiliency, and compression resiliency. The fluid seal 180 includes a center bore running down the length of the seal 180 and is configured for receiving the shank 120.

When the screw 108 of the fastener assembly 100 is tightened, the bottom of the tube seal 180 compresses against a surface, such as against a barrier sheet 22 to effectively seal the penetration by the screw 108 through the sheet 22 against air and water. At the same time, the top of the tube seal 180 compresses on the underside of the washer 140 to effectively seal the washer 140 against air and water. The underside of the washer 140 includes a central flat surface against which the tube seal 180 compresses. When the fastener assembly 100 with the fluid seal 180 is installed through a section of insulation 20, the fluid seal 180 seals against the insulation 20 to prevent fluid leaks between the fastener assembly 100 and the insulation 20. The fluid seal 180 may be at least equal to the length of the shank 120, or slightly longer than the shank 120 such that the fluid seal 180 contacts the air barrier 22 before the shank 120. Because the exemplary tube seal 180 of the present invention compresses on the air barrier 22 material and seals the penetration point in the air barrier 22 material, the air barrier's performance will be improved.

The fluid seal 180 may shorter than the shank 120 such that the fluid seal 180 butts up against the air barrier 22 with the shank 120 continuing through the gypsum sheathing 24 to bottom out on the stud 12, with reference to the inner wall construction shown in FIG. 5. The length of the shank 120 and seal 180 may be selected to match a thickness of insulation 20 and wall board. When the length of the seal 180 matches the insulation 10 thickness, the seal 180 will "bottom out" on the surface of the air barrier 22 covering the wall. By "bottoming out" the seal 180 on the surface of the air barrier 22, the hole created by the screw 108 when it passes through the air barrier 22 will be covered by the bottom of the tube seal 180, and the hole created by the shank 120 through the wall board will also be covered by the seal 180. When the screw 108 of the fastener assembly 100 is tightened, the bottom of the tube seal 180 compresses on the air barrier 22 to effectively seal the penetration against air and water.

Optionally, the wall may include studs 12 and an overlayer of exterior gypsum sheathing 24. In these scenarios where a layer of gypsum sheathing 24 is disposed between the studs and the air barrier 22, the tube seal 180 is shorter than the length of the shank 120 by a distance that is substantially equal to the thickness of the gypsum sheathing 24. In this embodiment, the rigid shank 120 cuts through and extends through the layer of gypsum sheathing 24 to bottom out on the stud 12, while the seal tube 180 compresses against the face of the air barrier 22, as well as the underside of the washer 140. This ensures an air and water tight seal between the fastener assembly 100 and the wall system 10.

Figure 7:
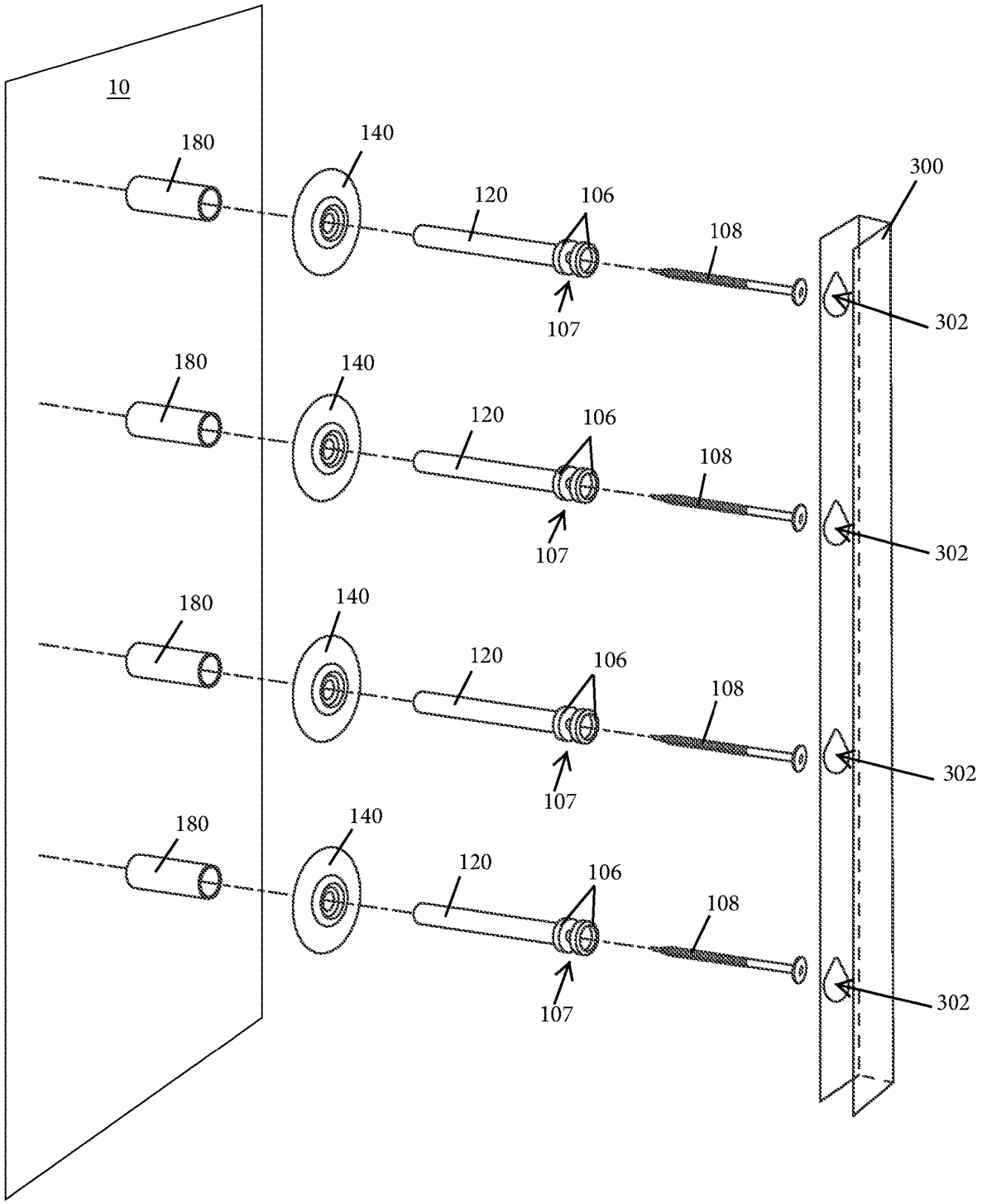
FIG. 7 is a perspective view of a wall fastener assembly in accordance with an embodiment of the present invention for a wall girt system.

In the illustrated embodiment of FIG. 7, a plurality of wall fastener assemblies 100 attach a girt/track system 300 for virtually any other type of cladding/sliding. The fasteners 100 would be drilled into place with a specific spacing (through the layer of continuous insulation, air barriers, sheathing, and into the substrate), and a length of track (possibly a z-girt, hat channel, or square tubing, etc.) with teardrop style holes 302 drilled into the backside of the track could be inserted over the protruding shank 120 and associated flanges 106 and slide down to lock the track onto the fastener 100 (with the teardrop style hole dropping into the groove 107). Virtually any type of cladding/siding could then be attached to the track. The benefits of this type of application are identical to those described with respect to the masonry veneer application: no steel-on-steel contact resulting in reduced thermal-bridging, and better sealing capability to maintain air barrier performance and reduce water leakage (i.e., no blindly driven fasteners required to attach the cladding to and through the underlying structure/substrate, rather attach the cladding/siding to the girts).

Changes and modifications in the specifically described embodiments can be carried out without departing from the principles of the present invention which is intended to be limited only by the scope of the appended claims, as interpreted according to the principles of patent law including the doctrine of equivalents.

The invention claimed is:

1. A wall fastener assembly, said wall fastener assembly comprising:

an elongated, tubular shank, wherein said shank comprises a center bore extending along the length of said shank, and wherein said shank comprises a pair of flanges positioned at a first end of said shank, wherein said pair of flanges are spaced apart to form a groove there between, and wherein said shank and said pair of flanges are unitarily formed of a non-metallic material;

a screw, wherein said center bore of said shank is configured for receiving said screw;

a washer having a through hole for receiving said shank, said washer having an upper surface and a bottom surface and with a portion on said upper surface configured for supporting an inner one of said pair of flanges; and wherein said screw is configured for securing said shank to a wall assembly with said bottom surface of said washer contacting the wall assembly and said portion on said upper surface of said washer supporting said inner one of said pair of flanges.

2. The wall fastener assembly of claim 1, wherein said shank has an outer shank diameter and wherein said shank further comprises a seal portion with said seal portion extending about a circumference of said shank and with said seal portion comprising a seal diameter that is greater than said outer shank diameter.

3. The wall fastener assembly of claim 2, wherein said seal portion is unitarily formed of the non-metallic material with said shank and said pair of flanges.

4. The wall fastener assembly of claim 2, wherein said shank has a second end opposite said first end, and wherein said seal portion is disposed on said shank closer to said second end than said first end.

5. The wall fastener assembly of claim 2, wherein said seal portion comprises a wedge seal having a tapered portion, wherein said tapered portion tapers in an axial direction along a portion of the elongated length of said shank.

6. The wall fastener assembly of claim 5, wherein said tapered portion of said wedge seal tapers from said seal diameter to said outer shank diameter.

7. The wall fastener assembly of claim 6, wherein said tapered portion tapers from said seal diameter to said outer shank diameter toward a second end of said shank opposite said first end.

8. The wall fastener assembly of claim 1, wherein said portion of said washer configured for supporting said inner one of said pair of flanges comprises a cavity on said washer.

9. The wall fastener assembly of claim 1, further comprising a masonry tie configured to be retained by said groove, said masonry tie comprising an opening with said groove configured to receive said masonry tie at said opening, and with said masonry tie comprising an extending portion configured for engaging with a masonry veneer.

10. The wall fastener assembly of claim 1, further comprising a girt track configured to be retained by said groove, said girt track including a hole with said groove configured to receive said girt track at said hole.

11. The wall fastener assembly of claim 1, wherein said screw is configured to be secured to a stud of the wall assembly with said bottom surface of said washer contacting an insulation layer of the wall assembly, and wherein said shank penetrates through the insulation layer and through an air barrier and a sheathing layer of the wall assembly.

12. A wall fastener assembly, said wall fastener assembly comprising:

an elongated, tubular shank, wherein said shank comprises an outer shank diameter and a center bore extending along the length of said shank, and wherein said shank comprises at least one flange positioned at a first end of said shank, wherein said at least one flange extends outwardly from said outer shank diameter, and wherein said shank and said at least of flange are unitarily formed of a non-metallic material;

a screw, wherein said center bore of said shank is configured for receiving said screw;

wherein said screw is configured for securing said shank to a wall assembly;

wherein said shank further comprises a seal portion with said seal portion extending about a circumference of said shank and with said seal portion comprising a seal diameter that is greater than said outer shank diameter, wherein said seal portion is unitarily formed of the non-metallic material with said shank and said at least one flange, and wherein said seal portion comprises a wedge seal having a tapered portion, wherein said tapered portion tapers in an axial direction along a portion of the elongated length of said shank.

13. The wall fastener assembly of claim 12, wherein said shank has a second end opposite said first end, and wherein said seal portion is disposed on said shank closer to said second end than said first end.

14. The wall fastener assembly of claim 12, wherein said tapered portion of said wedge seal tapers from said seal diameter to said outer shank diameter.

15. The wall fastener assembly of claim 14, wherein said tapered portion tapers from said seal diameter to said outer shank diameter toward a second end of said shank opposite said first end.

16. The wall fastener assembly of claim 12, wherein said shank further comprises an additional flange whereby said shank comprises a pair of said flanges, and wherein said pair of flanges are spaced apart to form a groove there between, and further comprising a masonry tie configured to be retained by said groove, said masonry tie comprising an opening with said groove configured to receive said masonry tie at said opening, and with said masonry tie comprising an extending portion configured for engaging with a masonry veneer.

17. The wall fastener assembly of claim 12, further comprising a girt track configured to be retained to the wall assembly by said wall fastener assembly.

18. A wall fastener assembly for affixing to a wall assembly, said wall fastener assembly comprising:

an elongated, tubular shank, wherein said shank comprises an outer shank diameter and a center bore extending along the length of said shank, and wherein said shank comprises at least one flange positioned at a first end of said shank, wherein said at least one flange extends outwardly from said outer shank diameter, and wherein said shank and said at least one flange are unitarily formed of a non-metallic material;

a screw, wherein said center bore of said shank is configured for receiving said screw;

wherein said screw is configured for securing said shank to the wall assembly;

wherein said shank further comprises a seal portion with said seal portion extending about a circumference of said shank and with said seal portion comprising a seal diameter that is greater than said outer shank diameter;

wherein said screw is configured to be secured to a stud of the wall assembly such that a second end of said shank is pressed against the stud, and wherein said shank penetrates through an insulation layer and through an air barrier and a sheathing layer of the wall assembly with said seal portion being located at the air barrier.

19. The wall fastener assembly of claim 18, wherein said seal portion is unitarily formed of the non-metallic material with said shank and said at least one flange, and wherein said seal portion comprises a wedge seal having a tapered portion, wherein said tapered portion tapers in an axial direction along a portion of the elongated length of said shank, and wherein said tapered portion tapers from said seal diameter to said shank diameter toward the second end of said shank opposite said first end.

20. The wall fastener assembly of claim 18, wherein said wall fastener assembly is configured to engage a girt track for mounting the girt track to the wall assembly.

* * * * *